US008851027B2

(12) United States Patent
Lee

(10) Patent No.: US 8,851,027 B2
(45) Date of Patent: Oct. 7, 2014

(54) THERMOSTAT HAVING ELASTIC MEMBER

(71) Applicants: Hyundai Motor Company, Seoul (KR); Kia Motors Corporation, Seoul (KR)

(72) Inventor: Philgi Lee, Suwon-si (KR)

(73) Assignees: Hyundai Motor Company, Seoul (KW); Kia Motors Corporation, Seoul (KR)

( * ) Notice: Subject to any disclaimer, the term of this patent is extended or adjusted under 35 U.S.C. 154(b) by 0 days.

(21) Appl. No.: 13/711,355

(22) Filed: Dec. 11, 2012

(65) Prior Publication Data

US 2014/0041603 A1 Feb. 13, 2014

(30) Foreign Application Priority Data

Aug. 9, 2012 (KR) ..... 10-2012-0087269

(51) Int. Cl.
*F01P 7/14* (2006.01)
*F01P 7/16* (2006.01)

(52) U.S. Cl.
CPC ..... *F01P 7/16* (2013.01)
USPC ..... 123/41.08

(58) Field of Classification Search
CPC ..... F01P 7/16; F01P 7/14; F01P 7/167; F01P 2007/146; F01P 3/20
USPC ..... 123/41.08
See application file for complete search history.

(56) References Cited

U.S. PATENT DOCUMENTS

| | | | | |
|---|---|---|---|---|
| 5,979,778 | A * | 11/1999 | Saur | 236/34.5 |
| 6,457,652 | B1 | 10/2002 | Fukamachi et al. | |
| 7,172,135 | B2 | 2/2007 | Masuko et al. | |
| 2010/0012738 | A1 * | 1/2010 | Park | 236/101 C |
| 2011/0095091 | A1 | 4/2011 | Suda et al. | |

* cited by examiner

*Primary Examiner* — Lindsay Low
*Assistant Examiner* — Charles Brauch
(74) *Attorney, Agent, or Firm* — Morgan, Lewis & Bockius LLP

(57) ABSTRACT

A thermostat apparatus may include a thermostat case formed of a first passage and a second passage, a valve body disposed in the thermostat case, wherein a first valve may be formed at one end side thereof to open or close the first passage, a retainer, one end portion of which may be mounted on the other end side of the valve body, wherein a second valve may be formed at the other end portion of the retainer to open or close the second passage, an elastic member that elastically biases the retainer in a direction to make the first valve close the first passage and make the second valve open the second passage, and a drive portion that may be configured to push the retainer in a direction that according to temperature, the first valve opens the first passage and the second valve closes the second passage.

10 Claims, 3 Drawing Sheets

THERMOSTAT HAVING ELASTIC MEMBER

CROSS-REFERENCE TO RELATED APPLICATION

The present application claims priority to Korean Patent Application No. 10-2012-0087269 filed on Aug. 9, 2012, the entire contents of which is incorporated herein for all purposes by this reference.

BACKGROUND OF THE INVENTION

1. Field of the Invention

The present invention relates to a thermostat having an elastic member that changes a passage of a coolant depending on the temperature of the coolant and actively controls the coolant temperature to prevent overheating thereof.

2. Description of Related Art

A thermostat for a vehicle is disposed between an engine and a radiator, is automatically opened/closed by the temperature variation of coolant to adjust the flow rate of the coolant, and therefore the temperature of the coolant is controlled in a predetermined range.

A mechanical thermostat expands wax depending on the temperature of the coolant, and the expanding force of the wax makes a piston move the valve of the thermostat.

The mechanical thermostat is operated in a predetermined opening/closing temperature of the coolant to open/close the valve only in a predetermined temperature condition, and therefore the mechanical thermostat does not actively move against changes of the driving circumstances of the vehicle.

Accordingly, an electrical thermostat has been introduced to complements the drawback of the mechanical thermostat, and the electrical thermostat is operated to sustain the coolant temperature in an optimized range.

The electrical thermostat actively controls the coolant temperature of the engine according to the driving circumstances such as the load level of the vehicle to sustain the optimized coolant temperature, and the electrical thermostat can improve fuel consumption efficiency and reduce exhaust gas.

As an exemplary embodiment, an electrical thermostat and a mechanical thermostat have three passages. A first passage is connected to a radiator, a second passage is connected to a coolant outlet of an engine, and a third passage is connected to a coolant inlet of an engine. Here, the coolant pump can be disposed between the third passage and the coolant inlet.

Meanwhile, a coil spring is disposed such that a first valve that is disposed in a valve body closes the first passage and the coil spring covers an exterior circumference of the valve body and therefore the coil spring deteriorates heat exchange efficiency between wax case that is disposed in the valve body and the coolant and increases flowing resistance of the coolant.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a thermostat having an elastic member having advantages of improving heat exchange efficiency between coolant and a wax case and reducing a coolant flowing resistance by varying the mounting structure of an elastic member.

In an aspect of the present invention, a thermostat apparatus may include a thermostat case formed of a first passage and a second passage, a valve body disposed in the thermostat case, wherein a first valve is formed at one end side thereof to open or close the first passage, a retainer, one end portion of which is mounted on the other end side of the valve body, wherein a second valve is formed at the other end portion of the retainer to open or close the second passage, an elastic member that elastically biases the retainer in a direction to make the first valve close the first passage and make the second valve open the second passage, and a drive portion that is configured to push the retainer in a direction that according to temperature, the first valve opens the first passage and the second valve closes the second passage.

One end of the elastic member elastically biases an upper support portion of the retainer toward the first valve, and the other end of the elastic member is supported onto a lower support portion that is formed on an interior circumference of the second passage in the thermostat case.

The upper support portion of the retainer is connected to the valve body.

The drive portion is inserted into a mounting space that is formed inside the valve body and moves the retainer and the valve body.

The drive portion may include a wax case that is disposed in the mounting space of the valve body, and wax that is charged in the wax case, wherein the valve body is slidably mounted on the wax case.

A coolant hole is formed on the valve body such that coolant flows from the outside into the inside of the valve body.

The drive portion may include a piston guide mounted in the retainer, a main piston that is disposed in the piston guide and pushes the retainer according to expansion of the wax by the temperature, and A drive portion insertion hole is formed in the retainer and the piston guide are inserted into the drive portion insertion hole, wherein a piston insert groove is formed at an inner side of the drive portion insertion hole and an end portion of the main piston is inserted into the piston insert groove.

The thermostat case may include a conflux space that is fluid-connected to the first passage and the second passage, and a third passage through which a fluid is exhausted from the conflux space is formed between the first passage and the second passage.

The elastic member may have a truncated circular cone shape in which an exterior diameter of the one end of the elastic member is smaller an exterior diameter of the other end of the elastic member.

In a thermostat having an elastic member according to an exemplary embodiment of the present invention, an elastic member is not formed around a part that the wax case where wax is charged is disposed, and therefore the heat exchange efficiency is increased between the wax case and the coolant.

Further, because the elastic member is not disposed around the exterior circumference of the valve body, the flowing of the coolant is not disturbed and the overall coolant flowing resistance is reduced.

In addition, because the wax quickly detects the temperature variation of the coolant, the temperature of the coolant is accurately and quickly controlled.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
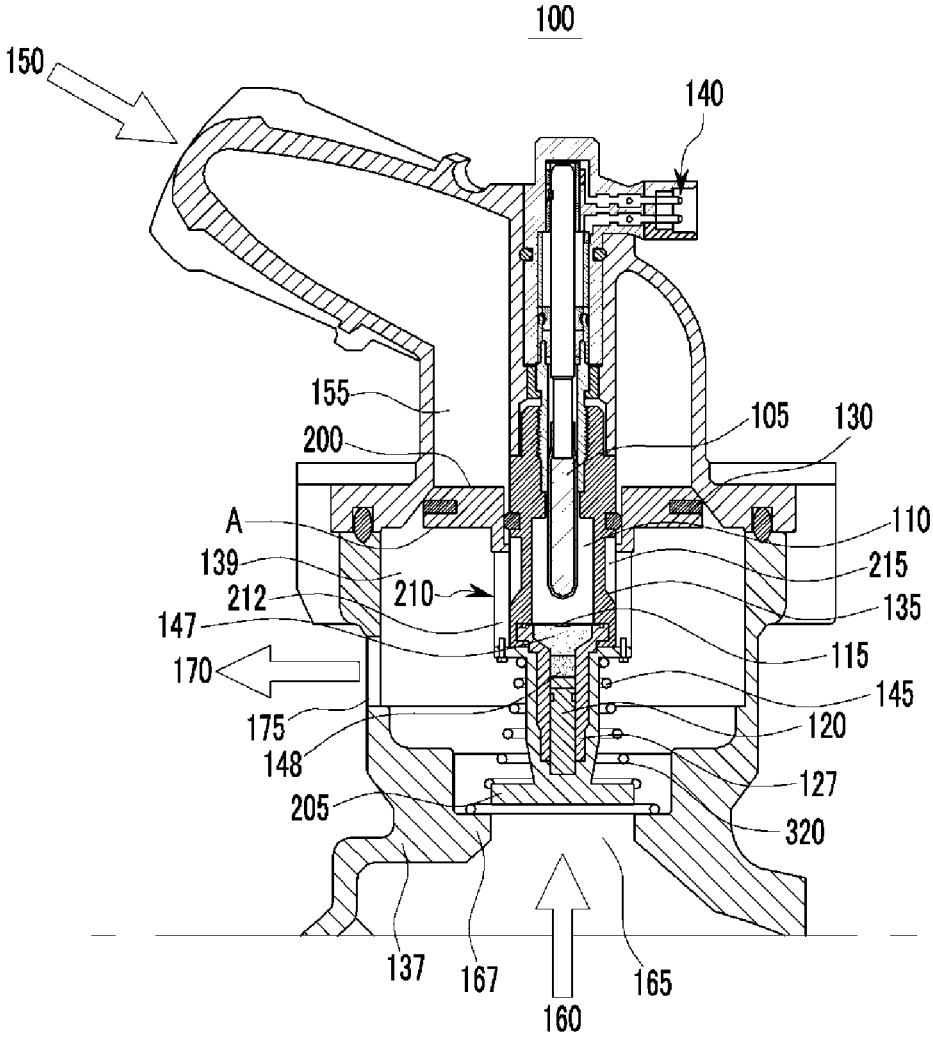
FIG. 1 is a cross-sectional view showing a case that a thermostat is not operated in an engine according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

FIG. 1 is a cross-sectional view showing a case that a thermostat is not operated in an engine according to an exemplary embodiment of the present invention.

Referring to FIG. 1, an engine having a thermostat includes a radiator 150, a coolant outlet 160 of an engine, a coolant inlet 170 of an engine, and a thermostat 100.

The thermostat 100 includes a thermostat case 137, and a first passage 155 is formed to be connected to the radiator 150, a second passage 165 is formed to be connected to the coolant outlet 160, and a third passage 175 is connected to the coolant inlet 170 in the thermostat case 137.

A coolant pump in an exemplary embodiment of the present invention is disposed between the third passage 175 and the coolant inlet 170 to circulate coolant from the thermostat 100 to the engine.

As shown in drawings, the first passage 155 is formed at an upper side in an upper direction, the second passage 165 is formed at a lower side in a lower direction, and the third passage 175 is formed between the first and second passages 155 and 165 in a left side direction.

A joining space 139 is formed in the thermostat case 137 to be connected to the first passage 155, the second passage 165, and the third passage 175, and a valve body 210 is disposed in the joining space 139.

A first valve 200 is integrally formed on an exterior circumference of an upper end portion of the valve body 210 to selectively open/close the first passage 155 and an upper end portion of a retainer 320 is disposed at a lower portion of the valve body 210.

A second valve 205 is integrally formed with an exterior circumference of a lower end portion of the retainer 320 to selectively open/close the second passage 165.

Further, a valve O-ring 130 is mounted along an exterior circumference of the first valve 200 to contact the interior circumference of the first passage 155. Here, an O-ring groove is formed at an exterior circumference of the first valve 200 and the valve O-ring 130 is disposed in the groove.

A mounting space is formed along a central portion of the valve body 210 from an upper end side to a lower end side, and a drive portion that moves the valve body 210 is inserted into the mounting space 215.

The drive portion includes a main piston 120, a rubber piston 148, a piston guide 127, a semi-fluid 147, a diaphragm 115, wax 110, a wax case 135, and a glow plug (heating element) 105, wherein the glow plug 105 is electrically connected to a connector 140.

Referring to the drawing, the wax case 135 is disposed in the mounting space 215 of the valve body 210 and wax is charged in the wax case 135. And, the piston guide 127 and the piston 120 are disposed in the retainer 320.

The main piston 120 protrudes through the piston guide 127 in a lower side direction, and the end portion thereof is disposed to push the retainer.

The coolant hole 212 is formed on the valve body 210 and the coolant flows through the coolant hole 212 to the mounting space, and the heat of the coolant is transferred to the wax case 135 and the wax 110.

The coolant hole 212 is extended in a length direction of the valve body 210 and is arranged in a circumference direction.

As shown in the drawings, the elastic member is not disposed on an exterior circumference of the valve body 210 and therefore the heat is efficiently transferred from the coolant to the wax 110 and the flowing resistance of the coolant is reduced.

The elastic member 145 is disposed inside the thermostat case 137 to elastically support the valve body 210 in an upper direction and is disposed at a lower side of the wax case 135 in an exemplary embodiment of the present invention.

Firstly, an upper end portion of the elastic member 145 elastically supports the retainer 320 in an upper direction, and a lower end portion of the elastic member 145 is supported by a lower support portion 167 that is formed in the third passage 175.

Here, the lower support portion 167 can be formed along an interior circumference of the third passage 175 continuously or intermittently.

Further, the lower support portion 167 can be integrally formed with the thermostat case 137 or can be separately mounted thereon. The elastic member 145 has a coil spring structure and the member 145 can be varied to another type as an elastic member in an exemplary embodiment of the present invention.

Figure 3:
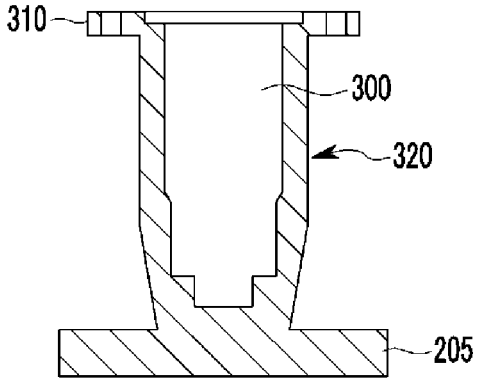
FIG. 3 is a detailed cross-sectional view of a retainer that is disposed in a thermostat according to an exemplary embodiment of the present invention.

Referring to FIG. 3, hereinafter the retainer 320 will be described. FIG. 3 is a detailed cross-sectional view of a retainer that is disposed in a thermostat according to an exemplary embodiment of the present invention.

Referring to FIG. 3, a drive portion insertion hole 300 is formed in the retainer 215, the main piston 120 and the piston guide 127 are inserted into the drive portion insertion hole 300, and the drive portion insertion hole 300 is opened in an upper direction.

An upper support portion 310 protrudes on an exterior circumference of an upper end portion inlet of the drive portion insertion hole 300 to support the upper end portion of the elastic member 145.

Referring to FIG. 1 and FIG. 3, an upper end portion of the elastic member 145 supports the upper support portion 310 of which the exterior diameter is short in an upper direction and a lower end portion of the elastic member 145 is supported by the lower support portion 167 of which the interior diameter is long.

Accordingly, the diameter of the upper portion of the elastic member 145 is small and the diameter of the lower portion thereof is larger, and therefore the elastic member 145 has a truncated circular cone shape.

The upper support portion 310 of the retainer 320 can be fixed on a lower end portion of the valve body 210 through an engaging method such as a bolting. Further, the retainer 320 can be integrally formed with a lower end portion of the valve body 210.

Figure 2:
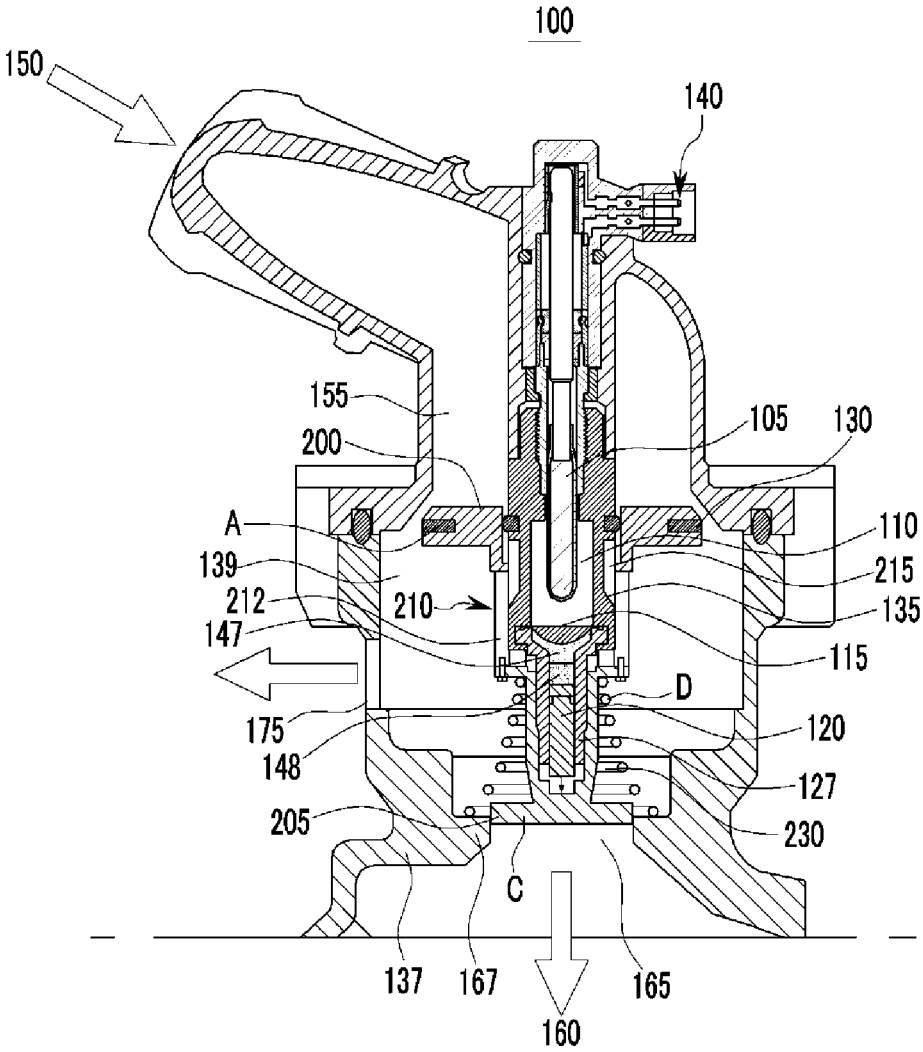
FIG. 2 is a cross-sectional view showing a case that a thermostat is operated in an engine according to an exemplary embodiment of the present invention.

FIG. 2 is a cross-sectional view showing a case that a thermostat is operated in an engine according to an exemplary embodiment of the present invention.

Referring to FIG. 2, the coolant that is flows in through the coolant outlet 160 passes the conflux space 139 to be supplied to the coolant inlet 170.

And, when the temperature of the coolant is increased or the current is supplied to the glow pug, the temperature of the wax 110 is increased.

While the temperature of the wax is increased, the wax 110 is expanded to expand the diaphragm 115 in a lower direction.

If the diaphragm 115 is expanded in a lower direction, the rubber piston 148 and the main piston 120 is moved thereby downward and the lower end portion of the main piston 120 pushes the retainer 320 in a lower direction.

Because the lower end portion of the valve body 210 is fixed on the upper end portion of the retainer 320, the valve body 210 and the retainer 320 are moved together.

Accordingly, the first valve 200 opens the first passage 155, and the second valve 205 closes the second passage 165 or reduces the opening rate of the passage 165. Resultantly, the coolant flow rate that flows through the second passage 165 is reduced, and the coolant flow rate that flows through the first passage 155 is increased.

Because the first passage 155 is connected to the radiator 150, the coolant flow rate that is cooled by the radiator 150 is increased. Accordingly, the temperature of the entire coolant is not raised to be sustained in a predetermined range.

Referring to FIG. 1 and FIG. 2, the valve body 210 has a structure that the coolant flows from the conflux space 139 of the thermostat case 137 to the mounting space 215.

Accordingly, the elastic member 145 is not disposed around the wax case 135 that the wax 110 is charged, and therefore the heat is effectively exchanged from the wax case 135 with coolant.

Meanwhile, if the elastic member 145 is disposed around the exterior circumference of the valve body 210, the flow of the coolant is disturbed by the member 145.

However, because the elastic member 145 is not disposed around the wax case 135 that the wax 110 is charged, the flow of the coolant is not disturbed in an exemplary embodiment of the present invention.

Accordingly, the wax 110 quickly detects the temperature of the coolant and the coolant temperature is quickly and accurately controlled.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A thermostat apparatus comprising:

a thermostat case including a first passage and a second passage;

a valve body disposed in the thermostat case, wherein a first valve is formed at a first end thereof to open or close the first passage;

a retainer, one end portion of which is mounted on a second end of the valve body, wherein a second valve is formed at the other end portion of the retainer to open or close the second passage;

an elastic member that elastically biases the retainer in a direction to make the first valve close the first passage and make the second valve open the second passage, wherein the elastic member extends from the one end portion of the retainer to the second passage; and a drive portion that is configured to push the retainer in a direction that according to temperature, the first valve opens the first passage and the second valve closes the second passage, wherein the drive portion is disposed in the valve body.

2. The thermostat apparatus of claim 1, wherein one end of the elastic member elastically biases an upper support portion of the retainer toward the first valve, and wherein the other end of the elastic member is supported onto a lower support portion that is formed on an interior circumference of the second passage in the thermostat case.

3. The thermostat apparatus of claim 2, wherein the upper support portion of the retainer is connected to the valve body.

4. The thermostat apparatus of claim 1, wherein the drive portion is inserted into a mounting space that is formed inside the valve body and moves the retainer and the valve body.

5. The thermostat apparatus of claim 4, wherein the drive portion includes:

a wax case that is disposed in the mounting space of the valve body; and wax that is charged in the wax case, wherein the valve body is slidably mounted on the wax case.

6. The thermostat apparatus of claim 5, wherein a coolant hole is formed on the valve body such that coolant flows from the outside into the inside of the valve body.

7. The thermostat apparatus of claim 5, wherein the drive portion includes:

a piston guide mounted in the retainer;

a main piston that is disposed in the piston guide and pushes the retainer according to expansion of the wax by the temperature.

8. The thermostat apparatus of claim 7, wherein a drive portion insertion hole is formed in the retainer and the piston guide are inserted into the drive portion insertion hole, and wherein a piston insert groove is formed at an inner side of the drive portion insertion hole and an end portion of the main piston is inserted into the piston insert groove.

9. The thermostat apparatus of claim 1, wherein the thermostat case includes:

a conflux space that is fluid-connected to the first passage and the second passage; and a third passage through which a fluid is exhausted from the conflux space is formed between the first passage and the second passage.

10. The thermostat apparatus of claim 2, wherein the elastic member has a truncated circular cone shape in which an exterior diameter of the one end of the elastic member is smaller an exterior diameter of the other end of the elastic member.

* * * * *